US006488084B1

(12) United States Patent
Borak, Jr.

(10) Patent No.: US 6,488,084 B1
(45) Date of Patent: Dec. 3, 2002

(54) CASING HANGER SEAL POSITIVE STOP

(75) Inventor: Eugene A. Borak, Jr., Cypress, TX (US)

(73) Assignee: ABB Vetco Gray Inc., Houston, TX (US)

( * ) Notice: Subject to any disclaimer, the term of this patent is extended or adjusted under 35 U.S.C. 154(b) by 0 days.

(21) Appl. No.: 09/696,494

(22) Filed: Oct. 25, 2000

(51) Int. Cl.[7] ..... E21B 23/01
(52) U.S. Cl. ..... 166/208; 166/88.3; 166/217
(58) Field of Search ..... 166/208, 209, 166/217, 118, 88.2, 88.3

(56) References Cited

U.S. PATENT DOCUMENTS

| | | | | |
|---|---|---|---|---|
| 1,727,583 A | | 9/1929 | Cant | |
| 1,728,432 A | | 9/1929 | Mildren | |
| 1,825,774 A | | 10/1931 | Boynton | |
| 2,232,884 A | | 2/1941 | Penick et al. | 285/22 |
| 2,610,689 A | | 9/1952 | Eckel | 166/14 |
| 2,683,045 A | | 7/1954 | Brooks | 285/22 |
| 2,712,455 A | | 7/1955 | Neilon | 285/22 |
| 3,051,513 A | | 8/1962 | Watts et al. | 285/146 |
| 3,134,610 A | | 5/1964 | Musolf | 285/3 |
| 3,204,695 A | | 9/1965 | Murray, Jr. | 166/55.6 |
| 3,255,823 A | | 6/1966 | Barton | 166/85 |
| 3,257,130 A | | 6/1966 | Watts et al. | 285/147 |
| 3,287,035 A | | 11/1966 | Greenwood | 285/147 |
| 4,306,742 A | | 12/1981 | Hardcastle | 285/147 |
| 4,595,063 A | * | 6/1986 | Jennings et al. | 166/382 |
| 4,678,209 A | | 7/1987 | Guice | 285/144 |
| 4,790,379 A | * | 12/1988 | Vanderford, Jr. | 166/208 |
| 5,031,695 A | * | 7/1991 | Cain et al. | 166/75.1 |
| 5,031,696 A | | 7/1991 | Zwiegel | 166/86 |
| 5,799,730 A | | 9/1998 | Lam et al. | 166/75.14 |
| 6,015,009 A | * | 1/2000 | Allen | 166/89.3 |

OTHER PUBLICATIONS

Advertisement entitled: *Wellhead Equipment—Typical Gray 10,000 psi Wellhead System*, p. 8 (undated).

* cited by examiner

*Primary Examiner*—David Bagnell
*Assistant Examiner*—Zakiya Walker
(74) *Attorney, Agent, or Firm*—Bracewell & Patterson, L.L.P.

(57) ABSTRACT

A casing hanger lands on a load shoulder in a wellhead to seal and support a string of casing. The casing hanger has a lower ring for landing on the load shoulder, the lower ring having an upward facing surface. A plurality of circumferentially spaced recesses are in the upward facing surface of the lower ring, each of the recesses having a base. A seal is located on the lower ring and has a plurality of holes that register with the recesses in the upward facing surface of the lower ring. A slip assembly bowl has a wedging surface that carries a plurality of slip members. The slip members grip the casing and cause the bowl to transmit downward forces from the casing to the seal to axially compress and energize the seal. Fasteners extend from the lower ring through apertures provided in the seal into threaded apertures provided in a downward facing surface of the bowl to secure the lower ring to the slip assembly but allow relative axial movement between the bowl and the lower ring. A plurality of substantially cylindrical stop members are located in the holes in the seal and in the recesses of the lower ring. The stop members are secured into threaded holes formed in the shoulder ring and contact the bases of the recesses to limit the compression of the seal to a predetermined amount.

6 Claims, 2 Drawing Sheets

CASING HANGER SEAL POSITIVE STOP

TECHNICAL FIELD OF THE INVENTION

The present invention relates to casing hangers for supporting and sealing a string of casing in a wellhead.

BACKGROUND OF THE INVENTION

In a typical oil or gas well, a string of casing is suspended from a load shoulder in wellhead by a casing hanger. The casing hanger has a lower ring that lands on the load shoulder, and a slip assembly grasps the string of casing. In one type of casing hanger, the weight of casing transmits through an elastomeric seal to a lower ring and to the load shoulder. The weight of the casing compresses the elastomeric seal axially and causes it to extrude radially into sealing contact with the casing string and the inner diameter of the wellhead.

Generally, the weight of the casing string is more than is needed to energize the seal, and the excess force can damage the seal. Therefore, prior art casing hangers incorporate a stop mechanism to limit the axial compression of the elastomeric seal and support the weight of the casing after the seal is energized.

One prior art casing hanger uses spacers which freely float within vertical holes in the seal. The spacers have a height less than the height of the seal, but are sized to transfer the load when the seal is compressed enough to seal the casing and casing head.

SUMMARY OF THE INVENTION

The present invention is drawn to a casing hanger for hanging and sealing a string of casing in a wellhead having a load shoulder therein. The casing hanger has a lower ring for landing on the load shoulder, the lower ring having an upward facing surface. A seal is positioned on the lower ring. The seal energizes when compressed axially to seal the casing to the wellhead. The seal has a plurality of circumferentially spaced holes. A slip assembly for gripping the casing has a downward facing surface that transmits downward forces from the weight of the casing to the seal to axially compress and energize the seal. Stop members are located in the holes in the seal and rigidly secured to one of the upward and downward facing surfaces to limit the compression of the seal to a predetermined amount.

DETAILED DESCRIPTION OF THE INVENTION

Figure 1:
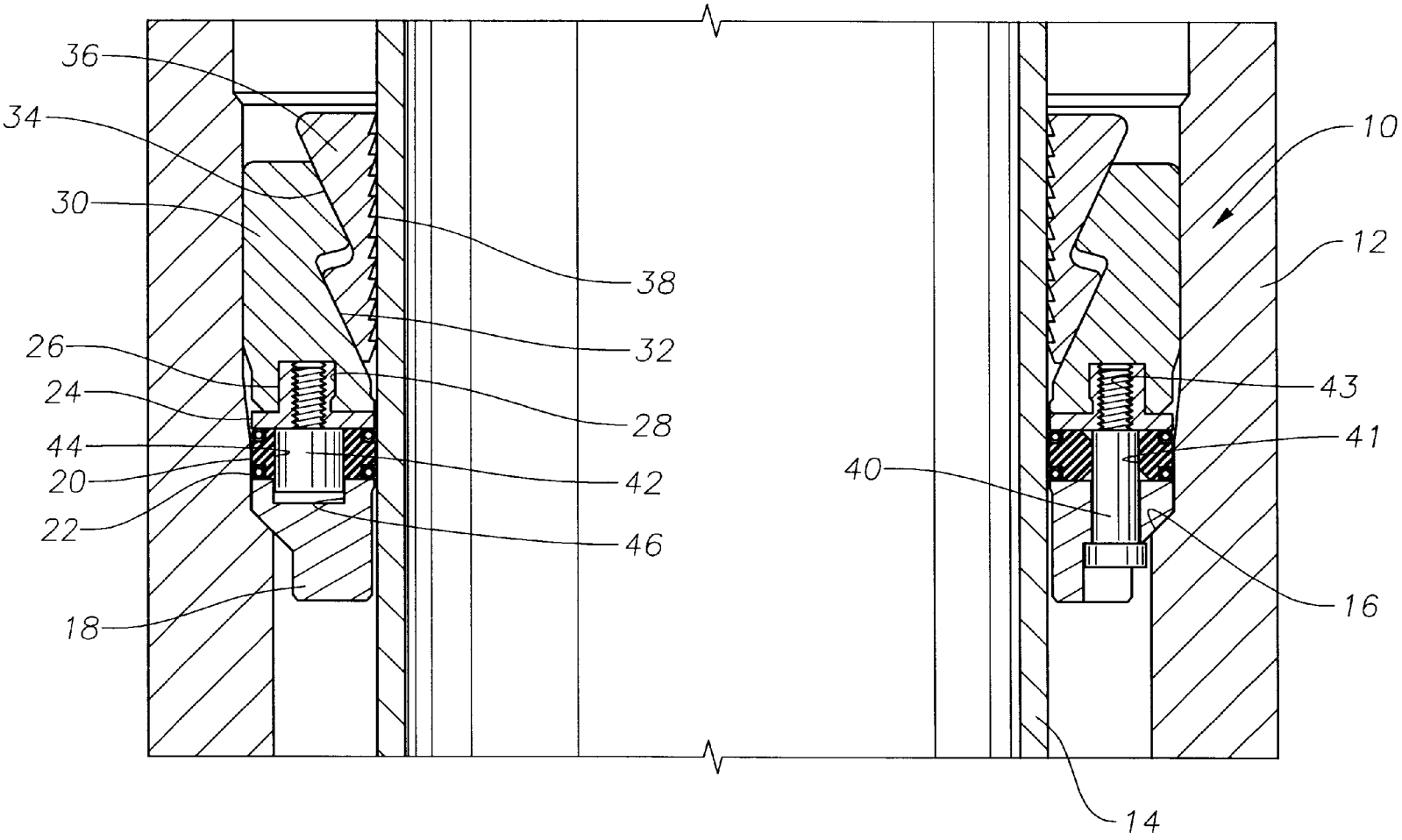
FIG. 1 is a vertical sectional view of a casing hanger assembly constructed in accordance with this invention and shown prior to setting.

Referring first to FIG. 1, a casing hanger 10 is shown in the process of landing in a wellhead housing 12 to support and seal a string of casing 14 concentrically therein. Housing 12 has an axial bore containing a load shoulder 16 that slopes inward and downward. Load shoulder 16 forms a step from a larger upper diameter to a smaller lower diameter in the bore.

Casing hanger 10 has a lower ring 18 adapted to land on load shoulder 16 as hanger 10 is lowered into casing head 12. Lower ring 18 abuts shoulder 16 and supports hanger 10. Lower ring 18 has a flat upward facing surface on which supports an elastomeric seal 20. Seal 20 is a conventional annular casing hanger seal adapted to expand radially and seal against both the outer diameter of casing 14 and the inner diameter of housing 12 when compressed axially. Seal 20 may have anti-extrusion devices 22 positioned at its edges and embedded in the elastomer to prevent the elastomer from excessively extruding when subject to high pressure differentials.

A shoulder ring 24 resides above seal 20 and has an upward extending annular protrusion 26. Protrusion 26 fits securely within a corresponding annular groove 28 of a slip bowl 30 to retain shoulder ring 24 with slip bowl 30. Shoulder ring 24 may be considered to be a part of slip bowl 30. Slip bowl 30 is a generally cylindrical member with an outer diameter sized to fit closely within the inner diameter of wellhead housing 12. The inner diameter of bowl 30 has one or more sloped surfaces 32 sloping inward and downward, and in the embodiment shown, it has two sloped surfaces 32. Surfaces 32 engage corresponding sloped surfaces 34 on an outer diameter of a plurality of slips 36. Slips 36 are segments of a cylindrical member, and when viewed in cross section form an upward and outwardly sloping wedge. The inner diameter. formed by slips 36 has a plurality of teeth 38 arranged in parallel rows for gripping casing 14 as casing 14 is moved downward relative to bowl 30. Thus, when slips 36 engage casing 14, the weight of casing 14 forces slips 36 downward, and sloped surfaces 32, 34 wedge slips 36 further into casing 14. At the same time, slips 36 exert a downward force on bowl 30, which compresses seal 20 between lower ring 18 and bowl 30. This compression causes seal 20 to expand into sealing engagement with wellhead housing 12 and casing 14.

Lower ring 18 is retained to shoulder ring 24, and thus to bowl 30, by a plurality of bolts 40. Bolts 40 pass loosely through openings in lower ring 18, loosely through holes 41 (FIG. 2) in seal 20, and thread into threaded sockets 43 in shoulder ring 24. The lengths of bolts 40 are selected to allow some relative axial movement between shoulder ring 24 and lower ring 18. The head of each bolt 40 will extend below its mating surface in lower ring 18 while in the set position shown in FIG. 3. During the running-in position of FIG. 1, the head of each bolt 40 will be in contact with a mating surface on the lower side of lower ring 18.

Figure 2:
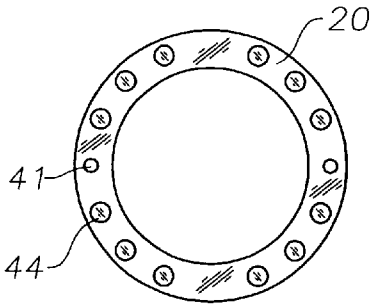
FIG. 2 is a top plan view of the seal of the casing hanger assembly of FIG. 1, shown removed from the casing hanger assembly.

A plurality of cylindrical stop members 42, each having a threaded stem 43, are threadingly attached to shoulder ring 24. Each stop member 42 is cylindrical and in the embodiment shown of a larger diameter than its stem 43. Stop members 42 pass through circumferentially spaced openings 44 in seal 20. The spacing of openings 44 is shown in FIG. 2. Each stop member 42 extends downward into a recess 46 in lower ring 18 sized to closely receive stop member 42 to guide stop members 42 as seal 20 is compressed. Recesses 46 have bases with a vertical depth sized such that stop members 42 bottom out in recesses 46 at a given compression of seal 20 and prevent further downward movement of bowl 30. This depth is chosen to correspond with the desired compression of seal 20, so that once seal 20 is compressed enough to seal against casing 14 and housing 12, the downward load from casing 14 is transmitted through stop members 42 into lower ring 18 rather than through seal 20.

Figure 3:
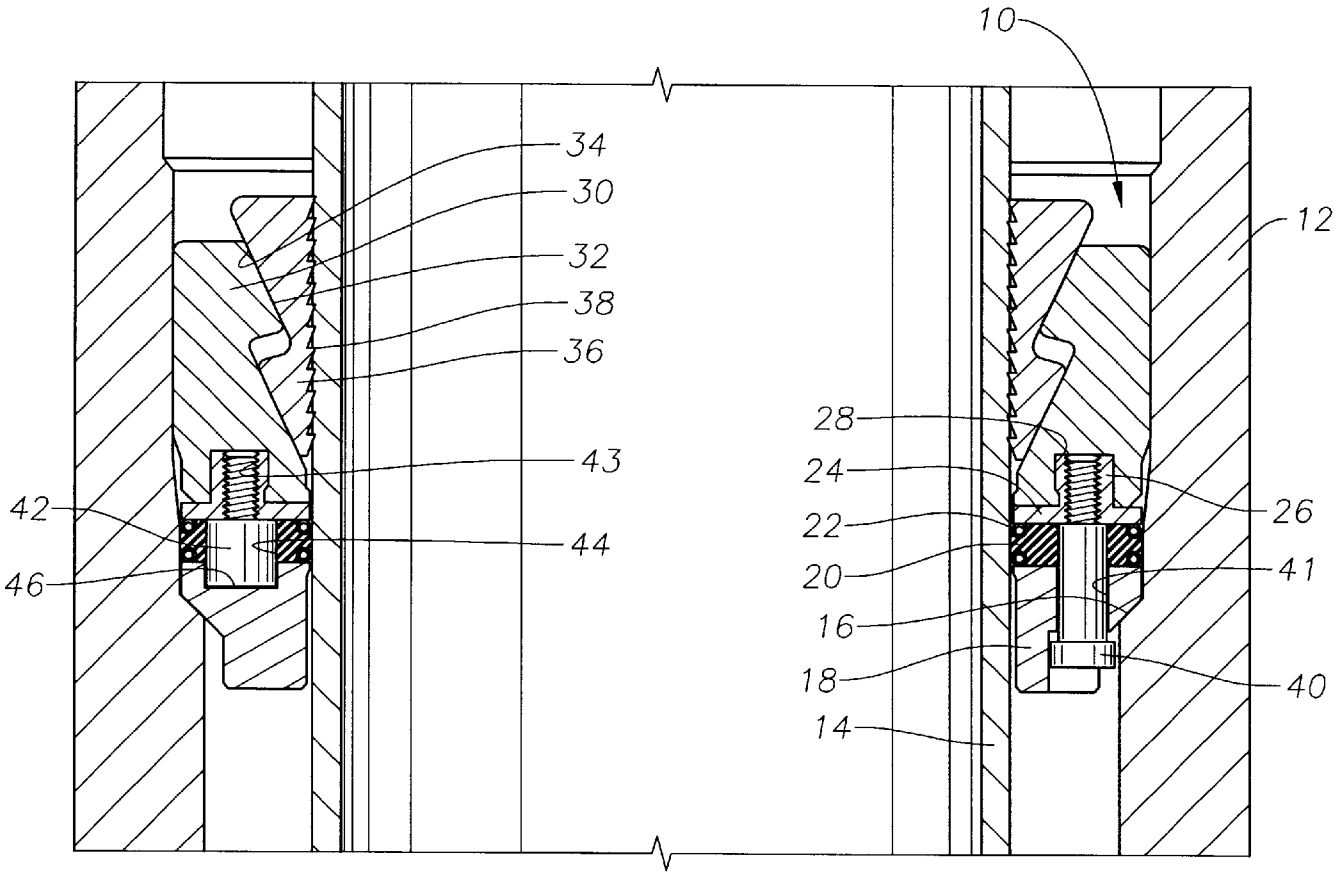
FIG. 3 is a vertical sectional view of the casing hanger assembly of FIG. 1, shown after setting.

In use, casing hanger 10 is landed on load shoulder 16 while casing 14 is suspended by a draw works of a drilling rig. In this running position, shown in FIG. 1, the lower ends of stop members 42 will be within recesses 46, but located above the bases of recesses 46. Casing 14 is then lowered and slips 36 engage its outer diameter. The weight of casing 14 wedges slips 36 harder into engagement with casing 14 and forces bowl 30 downward, compressing seal 20. Seal 20 expands radially into sealing contact with casing 14 and housing 12 until stop members 42 bottom out in recesses 46 and prevent further downward movement of bowl 30, as shown in FIG. 3. When contact is made, the weight of casing 14 is being carried by stop members 42 rather than seal 20. The weight transfers from stop members 42 through lower ring 18 and to load shoulder 16.

The present invention has several advantages. The stop members readily limit the amount of deformation allowed for the elastomer. The recesses guide the stop members between the upper position prior to setting and the set position.

While the invention has been shown in only one of its forms, it should be apparent to those skilled in the art that it is not so limited, but is susceptible to various changes and modifications without departing from the spirit thereof. For example, although the stop members are shown secured to the shoulder ring of the bowl, this arrangement could be inverted. The stop members could be secured to the lower ring and engage recesses formed in the shoulder ring of the bowl.

I claim:

1. In a wellhead assembly having a wellhead with a bore containing a load shoulder, a string of casing extending into the bore, and a casing hanger that lands on the load shoulder to support the string of casing, the casing hanger comprising:

a lower ring that lands on the load shoulder and has an upward facing surface;

an annular seal on the lower ring, the seal having a plurality of circumferentially spaced-apart holes therethrough;

a slip assembly including a bowl having a sloping surface and a plurality of slip members carried thereon, the slip members gripping the casing, the bowl having a downward facing surface located on top of the seal that transmits downward force from the weight of the casing to the seal to axially compress and energize the seal;

a plurality of fasteners that extend from the lower ring through apertures provided in the seal into threaded apertures provided in the downward facing surface of the bowl to secure the lower ring to the slip assembly but allow relative axial movement between the bowl and the lower ring;

a first one of the upward facing and downward facing surfaces having a plurality of circumferentially spaced recesses formed therein, each of the recesses having a base therein; and a plurality of stop members, each located in one of the holes in the seal and secured into threaded holes formed in a second one of the upward facing and downward facing surfaces, each of the stop members being slidingly received in one of the recesses and in contact with one of the bases to limit the compression of the seal to a predetermined amount.

2. The casing hanger of claim 1 wherein the recesses are located in the upward facing surface.

3. The casing hanger of claim 1 wherein the stop member is substantially cylindrical.

4. The casing hanger of claim 1 wherein the downward facing surface comprises a shoulder ring joined to the bowl of the slip assembly.

5. A casing hanger for landing on a load shoulder in a wellhead to seal and support a string of casing therein, the casing hanger comprising:

a lower ring for landing on the load shoulder having an upward facing surface;

a plurality of circumferentially spaced recesses in the upward facing surface of the lower ring, each of the recesses having a base;

a seal located on the lower ring and having a plurality of holes therethrough that register with the recesses in the upward facing surface of the lower ring;

a slip assembly comprising a bowl having a wedging surface and a plurality of slip members slidingly carried on the wedging surface of the bowl, the slip members adapted to grip the casing, the bowl having a downward facing surface that transmits downward forces from the casing to the seal to axially compress and energize the seal;

a plurality of fasteners that extend from the lower ring through apertures provided in the seal into threaded apertures provided in the downward facing surface of the bowl to secure the lower ring to the slip assembly but allow relative axial movement between the bowl and the lower ring; and a plurality of substantially cylindrical stop members, each located in one of the holes in the seal and in one of the recesses in the lower ring, the stop members being secured into threaded holes formed in the in the downward facing surface of the bowl, the stop members adapted to contact the bases of the recesses to limit the compression of the seal to a predetermined amount.

6. The casing hanger of claim 5 wherein the downward facing surface comprises a shoulder ring secured to a lower side of the bowl.

* * * * *